United States Patent [19]

Boileau et al.

[11] Patent Number: 4,842,658

[45] Date of Patent: Jun. 27, 1989

[54] AGING-RESISTANT SINGLE-BASE POWDER, PROCESS FOR MANUFACTURE, AND APPLICATION TO GAS GENERATORS

[75] Inventors: Jacques Boileau, Paris; Louis Leneveu, Chateaulin; Monique Tromeur, Daoulas, all of France

[73] Assignee: Societe Nationale des Poudres et Explosifs, Paris Cedex, France

[21] Appl. No.: 175,904

[22] Filed: Mar. 31, 1988

[51] Int. Cl.[4] ..... C06G 25/34

[52] U.S. Cl. ..... 149/92; 149/94; 149/96; 149/110; 264/3.3

[58] Field of Search ..... 149/92, 94, 96, 110; 264/3.3

[56] References Cited

U.S. PATENT DOCUMENTS

| | | | |
|---|---|---|---|
| 3,880,595 | 4/1975 | Timmerman | 149/77 |
| 4,029,529 | 6/1977 | Elrick et al. | 149/96 |
| 4,525,313 | 6/1985 | Muller | 264/3.3 |

*Primary Examiner*—Stephen J. Lechert, Jr.
*Attorney, Agent, or Firm*—Bucknam and Archer

[57] ABSTRACT

The present invention relates to nitrocellulose single-base propellent powders which exhibit good resistance to aging and to moisture. The powders according to the invention characteristically contain zinc carbonate whose particle size distribution is between 2 and 50 micrometers as an additive. The zinc carbonate is incorporated in the powder during the blending. The powders according to the invention find their preferred applications as propellent powders for ammunition intended for warships or for aircraft or as powders intended for gas generators for pyrotechnic devices.

12 Claims, 2 Drawing Sheets

Figure 1:
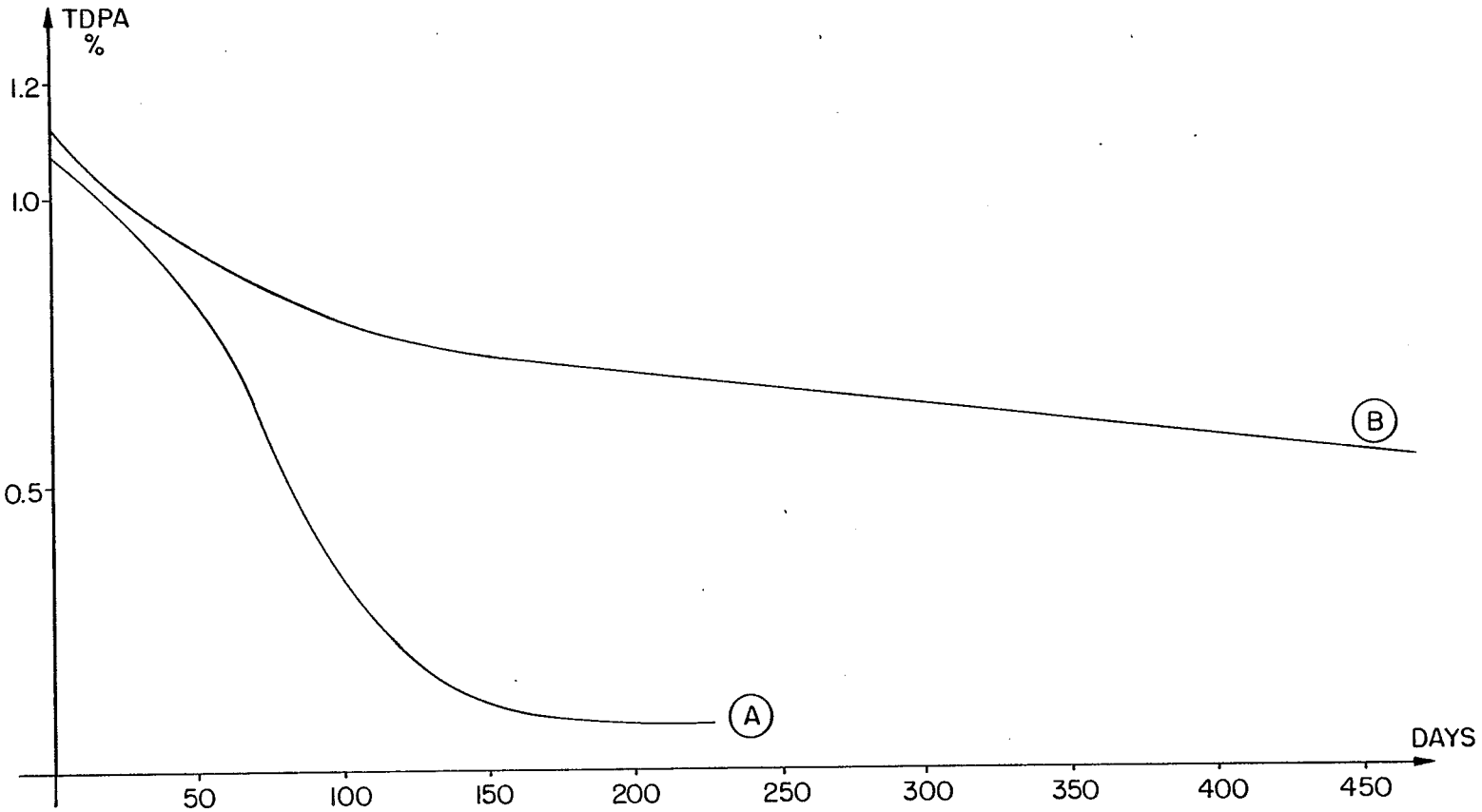

AGING-RESISTANT SINGLE-BASE POWDER, PROCESS FOR MANUFACTURE, AND APPLICATION TO GAS GENERATORS

The present invention relates to the field of nitrocellulose single-base propellent powders. More precisely, the invention relates to nitrocellulose single-base powders exhibiting good aging resistance.

Nitrocellulose powders are conventionally manufactured by the process known as "with a solvent". This process is described in two reference works: "Les poudres et explosifs" [Powders and explosives] by L. Vennin, E. Burlot and H. Lecorche, published in 1932 by the Librairie Polytechnique, pages 575 et seq., and "Les poudres, propergols et explosifs" [Powders, propellants and explosives] by J. Quinchon, J. Tranchant and M. Nicholas, volume 2, published by Technique et Documentation (Lavoisier) in 1984, pages 16 et seq., and volume 3, published in 1986, pages 41 et seq.

After a nitrocellulose impregnated with alcohol has been obtained, usual additives such as, for example, stabilizers and flash-reducers are added. All these are blended in the presence of suitable solvents chosen by the person skilled in the art. The dough thus obtained is then drawn out in the press and cut into grains. The grains are drained of liquid, soaked in water, dried, and generally smoothed with a burning moderator and are finally graphited.

The stabilizers are obligatory additives. Their main function is to react with the nitrous vapors generated by the denitration of the nitrocellulose. Since these vapours are autocatalytic, their presence increases the instability of the nitrocelluose. A powder will therefore be correspondingly more stable, the lower its consumption of stabilizer with time.

A good stabilizer must combine several important characteristics. It must be unreactive towards nitrocellulose. It must not form unstable compounds which are hygroscopic or capable of reacting with nitrocellulose. It must also be incapable of being eliminated from the powder under its storage conditions. The person skilled in the art has long been searching for stabilizers combining these qualities with no detriment to the powder's ballistic and thermodynamic properties.

Many stabilizers have been investigated. These include amyl alcohol, urea and its derivatives.

At the present time, the most widely employed stabilizers are diphenylamine and 2-nitrodiphenylamine.

Nevertheless, these stabilizers are truly efficient only under powder storage temperature conditions which are relatively moderate, and stability checks are necessary in the course of time, in order to monitor the consumption of stabilizer.

There is therefore a real need for a powder which remains stable for a long time, even when subjected to wide temperature differences during storage, and whose stability can be relied upon without the need for regular checks.

The objective of the present invention is precisely to provide a nitrocellulose single-base powder which exhibits good aging resistance.

The powder according to the invention is a nitrocellulose single-base powder containing a stabilizer and characterized by the fact that, in addition to the stabiliser, it contains zinc carbonate as an additive.

The invention also relates to a process for the manufacture of this powder by blending nitrocellulose in the presence of solvents and of a stabilizer, and extrusion and cutting into grains of the dough thus obtained, characterized in that zinc carbonate is incorporated during the blending.

Lastly, the invention also relates to a particular application of the powder according to the invention in gas generators for pyrotechnic devices.

A detailed description of the implementation of the invention is given below.

The powder according to the invention is a nitrocellulose single-base powder. Any of the nitrocelluloses which are suitable for the manufacture of so-called "smokeless" propellent powders may be employed as a nitrocellulose, that is to say nitrocelluloses whose nitrogen content is between 11.8% and 13.4%. A powder according to the invention necessarily contains a stabilizer such as diphenylamine or 2-nitrodiphenylamine. Besides the stabilizer, the powder may contain various usual additives which are known to the person skilled in the art such as, for example, dinitrotoluene or a phthalate or an additional energetic compound such as polyvinyl nitrate or, yet again, a flash-reducing agent such as potassium cryolite or potassium sulphate.

However, a powder according to the invention characteristically contains zinc carbonate as an additive, in addition to the stabilizer.

Anhydrous zinc carbonate and hydrated zinc carbonate can be employed equally well within the scope of the present invention.

The quantity of zinc carbonate present in the powder must be between 0.5% and 1.5% by weight relative to the quantity of dry nitrocellulose, and preferably between 0.8% and 1% by weight relative to the quantity of dry nitrocellulose.

The particle size distribution of the zinc carbonate employed is not without effect on the behaviour of the powder and the Applicant Company has noted that it is advantageous to employ a zinc carbonate whose particle size distribution is between 2 and 50 micrometers and, preferably, a zinc carbonate whose particle size distribution is virtually homogeneous and lying between 10 and 25 micrometers.

The powder according to the invention is manufactured according to the convenient process known by the name of a "solvent process".

After dehydration, the nitrocellulose is placed in a mixer in the presence of solvents. The stabilizer, optional additives and the zinc carbonate are then added.

The quantity of zinc carbonate incorporated during the blending is between 0.5% and 1.5% by weight relative to dry nitrocellulose, and preferably between 0.8% and 1.0%. The zinc carbonate employed preferably has a particle size distribution of between 2 and 50 micrometers and, in a particularly preferred manner, a particle size distribution which is virtually homogeneous and included between 10 and 25 micrometers.

The solvents employed are generally either a mixture of ethyl ether and ethyl alcohol or the mixture of ethyl alcohol and acetone. The mixer is then set to work until a homogeneous dough is obtained. A blending time of three hours is generally sufficient.

The dough thus obtained is then extruded into strands, either by means of a drawing press, or by means of an extruder, and these strands are then cut into grains.

The grains thus obtained are then drained of liquid, are soaked in water and are dried in the usual manner. Depending on the use for which they are intended, the grains may then be subjected to the conventional smoothing and graphiting operations.

The powders according to the invention exhibit energy contents which are substantially comparable to the energy contents of conventional nitrocellulose single-base powders but which exhibit a markedly improved aging resistance when compared with the latter. In particular, if a comparison is made of the change in the proportion of residual stabilizer as a function of time for a conventional powder and a powder according to the invention, it is found that this proportion drops abruptly after a certain time in the case of a conventional powder, whereas its decrease remains small and uniform in the case of a powder according to the invention, and this is so even under severe storage conditions.

A particularly valuable advantage of the powders according to the invention lies in the fact that their aging resistance is practically unaffected by the degree of humidity of the powder and that they retain an excellent aging resistance even at relatively high degrees of humidity.

Consequently, the powders according to the invention find a preferred application in all devices in which a nitrocellulose single-base powder is required to retain its properties after very long storage periods.

The powders according to the invention are equally suitable as powders for small, medium or large calibre arms. In particular, they find a tailor-made application in ammunition intended to be subjected to severe storage conditions, be it in respect of temperature or of the relative humidity, as is the case particularly with the ammunition intended to be taken aboard warships or aircraft.

However, the powders according to the invention also find a particularly advantageous application in gas generators for pyrotechnic devices, especially those comprising a gas expansion chamber. This applies to pyrotechnic actuators for bomb ejectors, pyrotechnic shears or valves and winders and stretching actuators for safety belts installed in motor vehicles.

Many safety devices are, in fact, controlled by pyrotechnic actuators comprising a gas generator delivering, in a very short time, a large volume of gas produced by the combustion of a propellant powder. These safety devices must be capable of operating perfectly even after not having been used over very long periods. This is particularly the case where motor vehicle safety is concerned. Many manufacturers are now fitting their vehicles with seat belts with a winder actuated by a pyrotechnic actuator fitted with a gas microgenerator. The pyrotechnic actuator must be capable of remaining unused for many years in a vehicle subjected to extreme weather conditions and of remaining capable of responding correctly in the event of an accident.

The powder according to the invention is particularly suitable for equipping gas generators or microgenerators intended for such actuators.

The examples which follow illustrate the invention without limiting its scope.

To illustrate the advantages of a powder according to the invention, the stability of a powder without zinc carbonate is compared with that of a powder containing zinc carbonate.

The approach is as follows:

After manufacture, the two powders are subjected to the extended aging test at 50° C.

The powders are conditioned in their equilibrium moisture content, at 65% relative humidity, and are then placed in Stanag tubes (sealed plug); under these conditions the moisture content of the powder grain is 1.63% (Fischer method). They are then kept at 50° C. for periods of time ranging stepwise from 21 to 450 days. The change in the stabilizer content has been measured by liquid phase chromatography.

EXAMPLE 1

Manufacture of a nitrocellulose single-base powder with stabilizer, but without zinc carbonate. The nitrocellulose employed has a nitrogen content of 13.30% and contains traces of calcium carbonate (approximately 125 ppm) originating from the water employed during the manufacture.

The following are introduced into the mixer:

| | |
|---|---|
| Dehydrated nitrocellulose | 5.00 kg |
| Diphenylamine (1.2%) | 0.06 kg |
| Ethyl ether | 3.04 kg |
| Ethyl alcohol | 1.71 kg |

After being blended for 3 hours, the dough thus obtained is drawn in a press through a 4.4 mm diameter die comprising 19 spikes 0.3 mm in diameter.

The strands are then cut into grains 4.31 mm in length.

These grains are then drained of liquid for 24 hours in free air and then for one hour at +50° C.

They are then soaked in water at 60° C. for 48 hours and finally dried for 16 hours in an oven at 60° C.

The grains of powder obtained in this manner have an energy content of 993 cal/g, i.e. 4,150 joules/g.

The change in the content of diphenylamine (TDPA) was measured by liquid phase chromatography.

The results are listed in Table 1.

EXAMPLE 2

Manufacture of a nitrocellulose single-base powder containing zinc carbonate, from a nitrocellulose identical with that employed in Example 1.

The following are introduced into the mixer:

| | |
|---|---|
| Dehydrated nitrocellulose | 5.00 kg |
| Diphenylamine (1.2%) | 0.06 kg |
| Zinc carbonate (0.8%) | 0.04 kg |
| Ethyl ether | 3.04 kg |
| Ethyl alcohol | 1.71 kg |

The zinc carbonate had a mean particle size of 13 micrometers.

The blending takes 3 hours.

The remainder of the process is identical with that described in Example 1.

The energy content of the powder grains thus obtained is 984 cal/g, ie.e. 4,110 joules/g. The results relating to the change in the diphenylamine (TDPA) content are listed in Table 1.

TABLE 1

| PA CONTENT % | INITIAL | 42 DAYS | 90 DAYS | 150 DAYS | 200 DAYS | 270 DAYS | 360 DAYS | 450 DAYS |
|---|---|---|---|---|---|---|---|---|
| EX. 1 | 1.08% | 0.90% | 0.40% | 0.10% | 0.08% | | | |

TABLE 1-continued

| PA CONTENT % | INITIAL | 42 DAYS | 90 DAYS | 150 DAYS | 200 DAYS | 270 DAYS | 360 DAYS | 450 DAYS |
|---|---|---|---|---|---|---|---|---|
| EX. 2 ($ZnCO_3$) | 1.12% | 0.93% | 0.93% | 0.72% | 0.70% | 0.67% | 0.59% | 0.55 |

The curves showing the change in the content of diphenylamine (TDPA) as a function of the aging time are given in FIG. 1, the curve A corresponding to Example 1 and the curve B corresponding to Example 2.

Inspection of these results leads to the conclusion that in the case of the conventional powder (Example 1, curve A), the diphenylamine content drops abruptly between 42 and 90 days, becoming almost nil after 200 days, with the powder then no longer containing any stabilizer, whereas in the case of the powder according to the invention, Example 2, curve B, this content diminishes slowly and uniformly throughout the aging test, with the powder still retaining two-thirds of its initial stabilizer content after 200 days and still more than one half of its initial stabilizer content after 450 days.

Insofar as the test at 50° C. is recognized as indicating the lifetime of the powder with time, the powders according to the invention will therefore be preserved for a longer time.

EXAMPLES 3 TO 8

These examples are intended to compare the effect of the degree of humidity on the aging resistance, between a conventional powder and a powder according to the invention.

To do this, six test specimens are made up from batches of powder of Examples 1 and 2:

Example 3: powder without zinc carbonate, conditioned to a moisture content of 0.43%, Example 4: powder without zinc carbonate, conditioned to a moisture content of 1.63%, Example 5: powder without zinc carbonate, conditioned to a moisture content of 2.14%, Example 6: powder with zinc carbonate, conditioned to a moisture content of 0.43%, Example 7: powder with zinc carbonate, conditioned to a moisture content of 1.63%, Example 8: powder with zinc carbonate, conditioned to a moisture content of 2.14%.

The moisture contents have been measured by the Fischer method.

These six test specimens have been placed in Stanag tubes and kept at 50° C. for 5 months.

The diphenylamine (TDPA) contents of these 6 test specimens at the end of this test are listed in Table 3.

TABLE 3

| EXAMPLE | 3 | 4 | 5 | 6 | 7 | 8 |
|---|---|---|---|---|---|---|
| TDPA | 0.62% | 0.10% | 0.01% | 0.79% | 0.72% | 0.71% |

Figure 2:
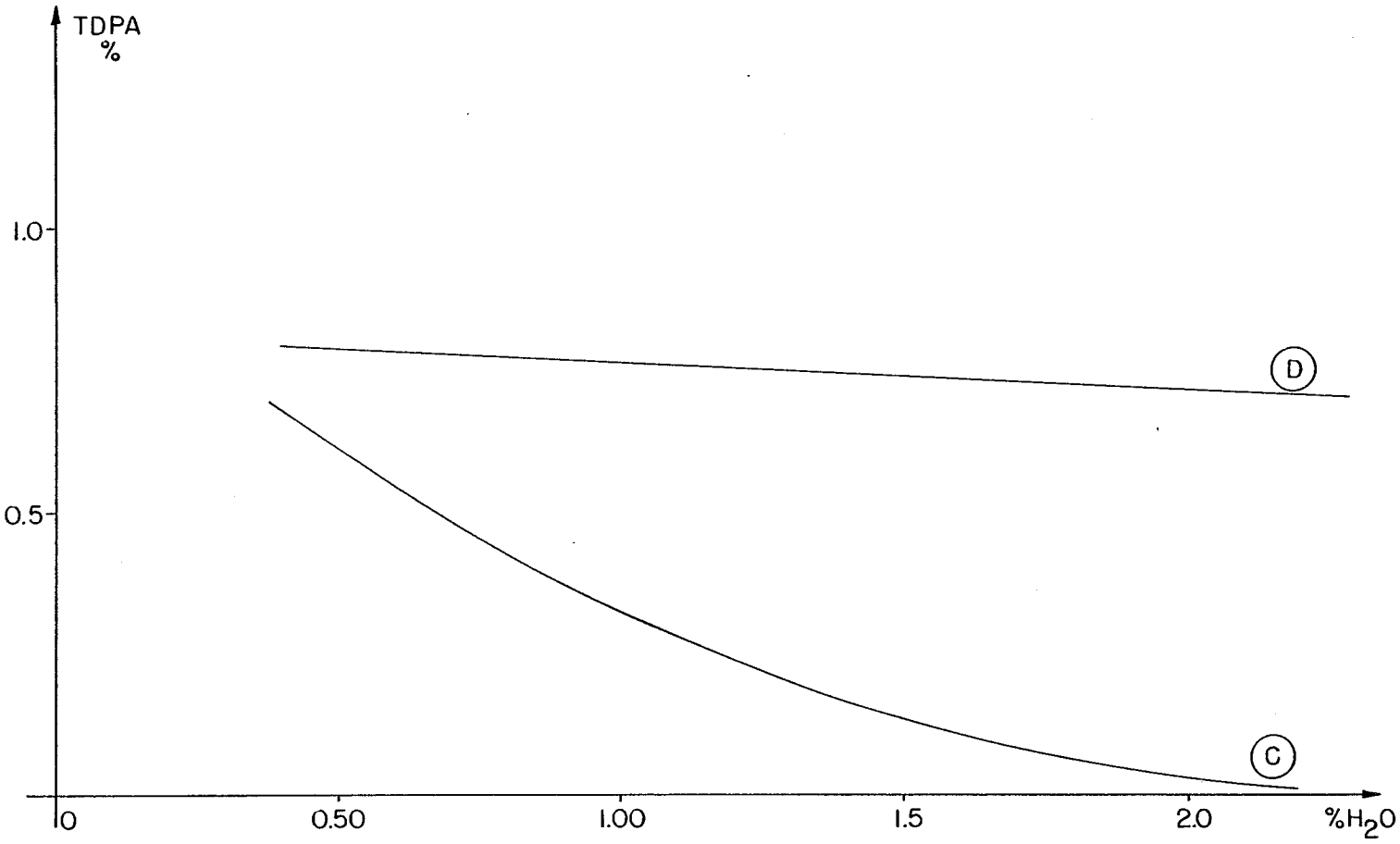

The curves showing the change in the diphenylamine (TDPA) content as a function of the moisture content of the powder are shown in FIG. 2, the curve C corresponding to Examples 3, 4 and 5 (powder without zinc carbonate), and the curve D corresponding to Examples 6, 7 and 8 (powder with zinc carbonate).

Inspection of these results leads to the conclusion that while the conventional powder (curve C) is highly sensitive to moisture, the aging resistance of the powder according to the invention (curve D) is practically unaffected by the moisture content.

We claim:

1. A nitrocellulose single-base propellant powder containing a stabilizer and zinc carbonate as an additive.

2. Powder according to claim 1, wherein the quantity of zinc carbonate is between 0.5% and 1.5% by weight relative to the dry nitrocellulose.

3. Powder according to claim 2, the quantity of zinc carbonate is between 0.8% and 1.0% by weight relative to the dry nitrocellulose.

4. Powder according to any one of claim 1, wherein the particle size distribution of the zinc carbonate is between 2 and 50 micrometers.

5. Powder according to claim 4, wherein the particle size distribution of the zinc carbonate is between 10 and 25 micrometers.

6. A process for the manufacture of a nitrocellulose single base propellant powder containing a stabilizer and zinc carbonate which consists of blending in the presence of solvents, nitrocellulose, a stabilizer and zinc carbonate until a homogeneous dough is obtained and then extruding said dough into strands, cutting said strands into grains and drying.

7. The process according to claim 6 wherein the quantity of zinc carbonate is between 0.5% and 1.5% by weight relative to dry nitrocellulose.

8. The process according to claim 6 wherein the particle size distribution of the zinc carbonate is between 2 and 50 micrometers.

9. The process according to claim 8 wherein the particle size distribution of the zinc carbonate is between 10 and 25 micrometers.

10. A gas generator for a pyrotechnic device containing the powder according to claim 1.

11. An ammunition containing the powder according to claim 1.

12. The gas generator according to claim 10 wherein the pyrotechnic device comprises a gas expansion chamber.

* * * * *